US007142074B2

(12) United States Patent
Kim et al.

(10) Patent No.: US 7,142,074 B2
(45) Date of Patent: Nov. 28, 2006

(54) MULTILAYER WAVEGUIDE FILTER EMPLOYING VIA METALS

(75) Inventors: Bong-Su Kim, Daejon (KR); Myung-Sun Song, Daejon (KR)

(73) Assignee: Electronics and Telecommunications Research Institute (KR)

( * ) Notice: Subject to any disclaimer, the term of this patent is extended or adjusted under 35 U.S.C. 154(b) by 0 days.

(21) Appl. No.: 10/866,047

(22) Filed: Jun. 10, 2004

(65) Prior Publication Data

US 2004/0251992 A1 Dec. 16, 2004

(30) Foreign Application Priority Data

Nov. 6, 2003 (KR) ..... 10-2003-0078477

(51) Int. Cl.
*H01P 1/208* (2006.01)

(52) U.S. Cl. ..... 333/208; 333/239

(58) Field of Classification Search ..... 333/202, 333/208, 212, 239
See application file for complete search history.

(56) References Cited

U.S. PATENT DOCUMENTS 5,150,088 A 9/1992 Virga et al.
5,157,364 A 10/1992 Pond et al.
5,382,931 A 1/1995 Piloto et al.
6,137,383 A 10/2000 De Lillo
6,178,311 B1 * 1/2001 Pance et al. ..... 455/78
6,535,083 B1 3/2003 Hageman et al.
6,639,487 B1 * 10/2003 Salmela et al. ..... 333/34
6,788,918 B1 * 9/2004 Saitoh et al. ..... 455/81
6,927,653 B1 * 8/2005 Uchimura et al. ..... 333/208

FOREIGN PATENT DOCUMENTS

EP 1302999 A1 * 4/2003
JP 2002-026611 1/2002

OTHER PUBLICATIONS

Deslandes et al., "Integrated Microstrip and Rectangular Waveguide in Planar Form," IEEE Microwave & Wireless Components Letters, vol. 11, No. 2, Feb. 2001, pp. 68-70.*
Rong et al., "LTCC Wide-Band Ridge-Waveguide Bandpass Filter," IEEE Trans. on Microwave Theory & Tech., vol. 47, No. 9, Sep. 1999, pp. 1836-1840.*
Rong et al., "Low Temperature Cofired Ceramic (LTCC) Ridge Waveguide Bandpass Chip Filters," IEEE Trans. on Microwave Theory & Tech., vol. 47, No. 12, Dec. 1999, pp. 2317-2324.*
Deslandes et al., "Single-Substrate Integration Technique of Planar Circuits and Waveguide Filters," IEEE Trans. on Microwave Theory & Tech., vol. 51, No. 2, Feb. 2003, pp. 593-596.*
Rong et al., "Low Temperature Cofired Ceramic (LTCC) Ridge Waveguide Bandpass filters," 1999 IEEE MTT-S Digest, 1999, pp. 1147-1150.

* cited by examiner

*Primary Examiner*—Seungsook Ham
(74) *Attorney, Agent, or Firm*—Blakely Sokoloff Taylor & Zafman

(57) ABSTRACT

A waveguide filter is disclosed. The waveguide filter includes a lower conductive layer; a plurality of dielectric layers stacked on the lower conductive layer; an upper conductive layer formed on a top surface of the plurality of dielectric layers; a waveguide formed on the upper conductive layer; and two sets of first via metals arranged at longitudinal sides of the waveguide filter, wherein each of the sets is formed in two-fold line shape.

9 Claims, 5 Drawing Sheets

MULTILAYER WAVEGUIDE FILTER EMPLOYING VIA METALS

FIELD OF THE INVENTION

The present invention relates to a waveguide filter; and, more particularly, to a waveguide filter employing a multilayer ceramic structure for passing a selected frequency by using a plurality of via metals.

DESCRIPTION OF RELATED ARTS

Recently, a wireless communication technology has been developed to an international mobile telecommunication-2000 (IMT-2000), which is a $3^{rd}$ generation wireless communication system and now, we expect that the communication system will be developed to a $4^{th}$ generation of wireless communication technology in the near future.

In the $4^{th}$ generation of wireless communication technology, it is expected that mass amount of video and audio data are transmitted in a speed of 100 Mbps by using a millimeter wave.

Generally, a miniaturization and a cost-effectiveness are major factors in developing a wireless communication system for processing a millimeter wave. A filter is the most complicated component among various electric components in a typical wireless communication system for miniaturizing and downing a cost. Specially, a waveguide filter must be manufactured with a predetermined size according to a desired frequency to process. Also, various flanges or transitions are required to be included in the waveguide filter according to a type of transmission.

Accordingly, a conventional waveguide filter occupies a large area in a wireless communication system and a manufacturing cost of the conventional waveguide filter is high.

For overcoming the above mentioned problem, one of conventional embedded ridge waveguide filter is disclosed in U.S. Pat. No. 6,535,083 B1 which is issued to Hageman et al. on Mar. 18, 2003, entitled "EMBEDDED RIDGE WAVEGUIDE FILTERS".

The embedded ridge waveguide filter includes both side walls of waveguide formed by a predetermined number of vias formed on a metal ground layer within a predetermined distance; a ridge formed by a predetermined pattern of a plurality of vias instead of using a conductor; and an input and an output ports formed by forming a predetermined pattern of strip line on a Low Temperature Cofired Ceramics (LTCC).

However, the embedded ridge waveguide filter has several drawbacks. According to a rule of forming vias, a plurality of vias formed on the metal ground layer must be formed with a predetermined distance. Therefore, the number of vias formed on the metal ground layer as the both side wall is limited. It may cause to generate an insertion loss. Also, a height of waveguide may not be controlled to a desired height for connecting to other electric device such as an antenna. Furthermore, since the input and the output ports is formed inside of multilayered plates as the patterned strip line, it requires another transition for connecting to other electric components in a communication system and measuring.

SUMMARY OF THE INVENTION

It is, therefore, an object of the present invention to provide a waveguide filter employing a multilayer ceramic structure including two side wall via patterns by using a plurality of first via metals.

It is another object to the present invention to provide a waveguide filter employing a multilayer ceramic structure including a plurality of second via metals within a predetermined pattern as an E planar metal strip to have desired characteristics of the waveguide filter.

In accordance with an aspect of the present invention, there is provided a waveguide filter includes: a lower conductive layer; a plurality of dielectric layers stacked on the lower conductive layer; an upper conductive layer formed on a top surface of the plurality of dielectric layers; a waveguide formed on the upper conductive layer; and two sets of first via metals arranged at longitudinal sides of the waveguide filter, wherein each of the sets is formed in two-fold line shape.

BRIEF DESCRIPTION OF THE DRAWINGS

The above and other objects and features of the present invention will become better understood with regard to the following description of the preferred embodiments given in conjunction with the accompanying drawings, in which.

DETAILED DESCRIPTION OF THE INVENTION

Hereinafter, a waveguide filter formed with a plurality of via metals in accordance with a preferred embodiment of the present invention will be described in more detail with reference to the accompanying drawings.

There are provided in FIGS. 1 to 5 illustrating various views of a waveguide filter provided with a plurality of via metals. It should be noted that like parts appearing in FIGS. 1 to 5 are represented by like reference numbers.

Figure 1:
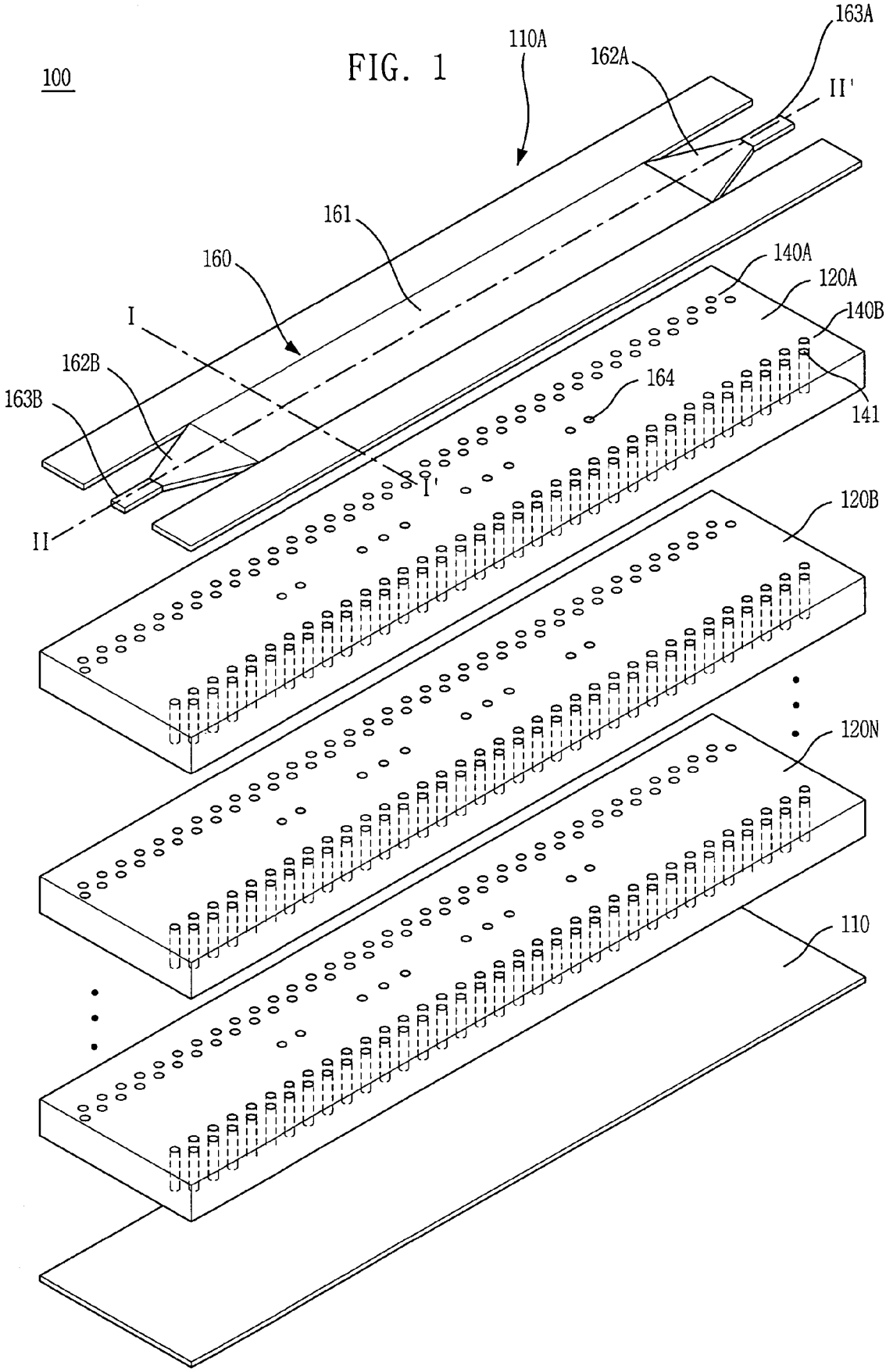
FIG. 1 is an exploded view illustrating a waveguide filter in accordance with a preferred embodiment of the present invention.

FIG. 1 is an exploded view illustrating a waveguide filter in accordance with a preferred embodiment of the present invention.

As shown, the waveguide filter 100 includes a lower conductive layer 110, N number of dielectric layers 120A, 120B, . . . 120N, stacked on the lower conductive layer 110 and an upper conductive layer 110A formed on the first dielectric layers 120A, wherein the lower and the upper conductive layers 110A, 110B serve as a ground. A first and a second side wall via patterns 140A, 140B are formed in both sides of the N number of dielectric layers 120A, 120B, . . . , 120N with penetrating from the first dielectric layer 120A to the $N^{th}$ dielectric layer 120N. In the preferred embodiment of the present invention, the plurality of the dielectric layers 120A to 120N is made of low temperature cofired ceramics (LTCC).

Each of sidewall via patterns 140A, 140B includes a plurality of via metals 141 arranged in such a way that they are aligned in two lines along the longitudinal edge lines of the dielectric layers. The plurality of via metals 141 of the first and the second side wall via patterns 140A, 140B is arranged in two-fold line shape and in a zigzag fashion. By arranging the plurality of via metals 141 in a form of two lines and in two-fold line and a zigzag fashion, a distance between the plurality of via metals 141 becomes narrow.

The plurality of via metals 141 are arranged to both ends of the longitudinal edge lines of the dielectric layers. That is, the plurality of via metals 141 are arranged to cover both input/output ports 163A and 163B for preventing to loss a signal flowing through a filtering unit 161 and a pair of transitions 162A, 162B of the waveguide 160.

In accordance with the preferred embodiment of the present invention, the first and the second side wall via patterns 140A, 140B in capable of reducing the insertion loss, since it prevents the signal passing through the waveguide and the converter from penetrating through the dielectric layers.

The upper conductive layer 110A of the waveguide filter 100 includes a waveguide 160 formed between the first and the second sidewall via patterns 140A, 140B, wherein the waveguide 160 is provided with a filtering unit 161, a pair of transitions 162A, 162B and a pair of input/output ports 163A, 163B.

The filtering unit 161 is formed on a middle of the waveguide 160 including a plurality of via metals 164. The plurality of via metals 164 is coupled to a bottom of the waveguide 160. The filtering unit 161 is made of a conductive material such as a metal. The plurality of via metals 164 is filled with a conductive material such as a metal and is arranged in a form of a line within a predetermined distance between a plurality of via metals 164 as a metal strip of a conventional E planar metal strip waveguide filter. The predetermined distance between the via metals 164 decides a filter characteristic of the waveguide filter 100.

The pair of transitions 162A, 162B is coupled to both sides of the filtering unit 161. The pair of input/output ports 163A, 163B is coupled to each of the pair of transitions 162A, 162B, respectively. A width and a length of each of the pair of transitions 162A, 162B are adjusted for matching an impedance of the pair of input/output ports 163A, 163B with an impedance of the filtering unit 161 in order to easily transit signals from one input/output port 163A through the filtering unit 161 to another input/output port 163B. The pair of input/output ports 163A, 163B can be implemented by using various transmission lines such as a microstrip line (MS), a strip line (SL) or a coplanar-Waveguide (CPW). Depends on the type of transmission lines, the width and the length of the pair of transitions 162A, 162B are changed.

The waveguide filter 100 receives a signal at the input/output port 163A and the signal is passed through the waveguide 160. The signal of undesired frequency is filtered by resonance excited according to the filter characteristic of the waveguide filter 100. At the input/output ports 162B, a signal of desired frequency is outputted.

Figure 2:
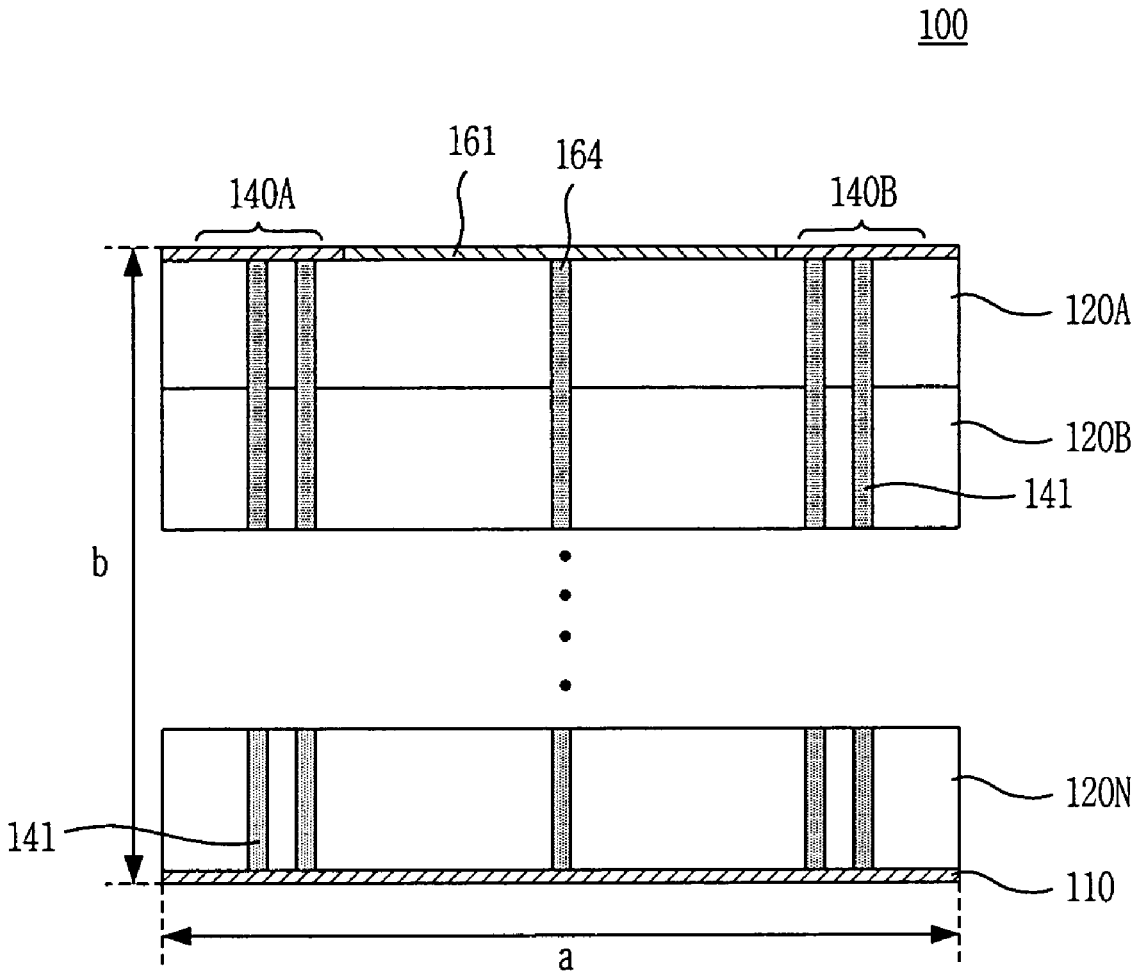
FIG. 2 is a cross sectional view taken along with I–I' of a waveguide filter in FIG. 1.

FIG. 2 is a cross sectional view taken along with I–I' of a waveguide filter in FIG. 1.

As shown, two lines of a plurality of via metals 141 is arranged as a first and a second side wall via patters 140A, 140B with penetrating from the first dielectric layer 120A to the Nth dielectric layer 120N. Ideally, the plurality of via metals 141 is arranged without a distance between the plurality of via metals 141. However, the plurality of via metals 141 must be arranged within a predetermined distance according to a durability of a material used as dielectric layers. If the via metals 141 are arranged within a distance shorter than the predetermined distance, the dielectric layer would be tore. That is, a distance between via metals is limited by a design rule according to the material of dielectric layer. Hereinafter, a minimum distance allowed by the design rule is called a limited distance. In the preferred embodiment of the present invention, two lines of the plurality of via metals 141 is arranged within the limited distance in the form of zigzag fashion in order to reduce an insertion loss caused by the limited distance between the plurality of via metals 141.

A wave length $\lambda_g$ of the waveguide filter 100 is decided by following equation:

$$\lambda_g=2\pi/\beta=2\pi\sqrt{k^2-k_c^2}, \qquad \text{Eq. 1}$$

wherein $k=\overline{\omega}\sqrt{\mu\in}$, $k_c=\sqrt{(m\pi/a)^2+(n\pi/b)^2}$, $\beta$ is a propagation constant, k is a number of wave, $k_c$ is a number of cut-off wave, a is a width of a waveguide filter, b is a height of a waveguide filter, m is a constant for electric field mode and n is a constant for magnetic field mode.

That is, the wave length $\lambda_g$ is decided based on a difference between the number of wave k and the number of cut-off wave $k_c$. The number of cut-off wave is decided according to a magnetic field mode and an electric field mode of the waveguide filter 100. However, a magnetic field excited in a waveguide does not influence to filter frequencies of input signal for obtaining an output signal with a desired frequency. Therefore, the constant of magnetic field mode n is set to 0 and thus, the height b is not a critical factor to consider for obtaining desired wave length in the waveguide filter 100. Accordingly, a height of the waveguide filter 100 can be changeable without affecting the filter characteristics of the waveguide filter 100.

By considering k is much larger than $k_c$ in a millimeter wave, Eq. 1 can be simplified to understand that the wave length $\lambda_g$ of the waveguide filter 100 is inversely proportional to $\sqrt{\in_r}$, wherein $\in_r$ is a dielectric constant of material of the dielectric layer. Accordingly, if a conventional E-planar metal strip waveguide filter is manufactured by an air, a height, a width and length of the conventional waveguide filter are enlarged in a ratio of $\sqrt{\in_r}$, in comparison with the present invention in order that the conventional E-planar metal strip waveguide filter has a filter characteristic identical to that of the waveguide filter 100.

Figure 3:
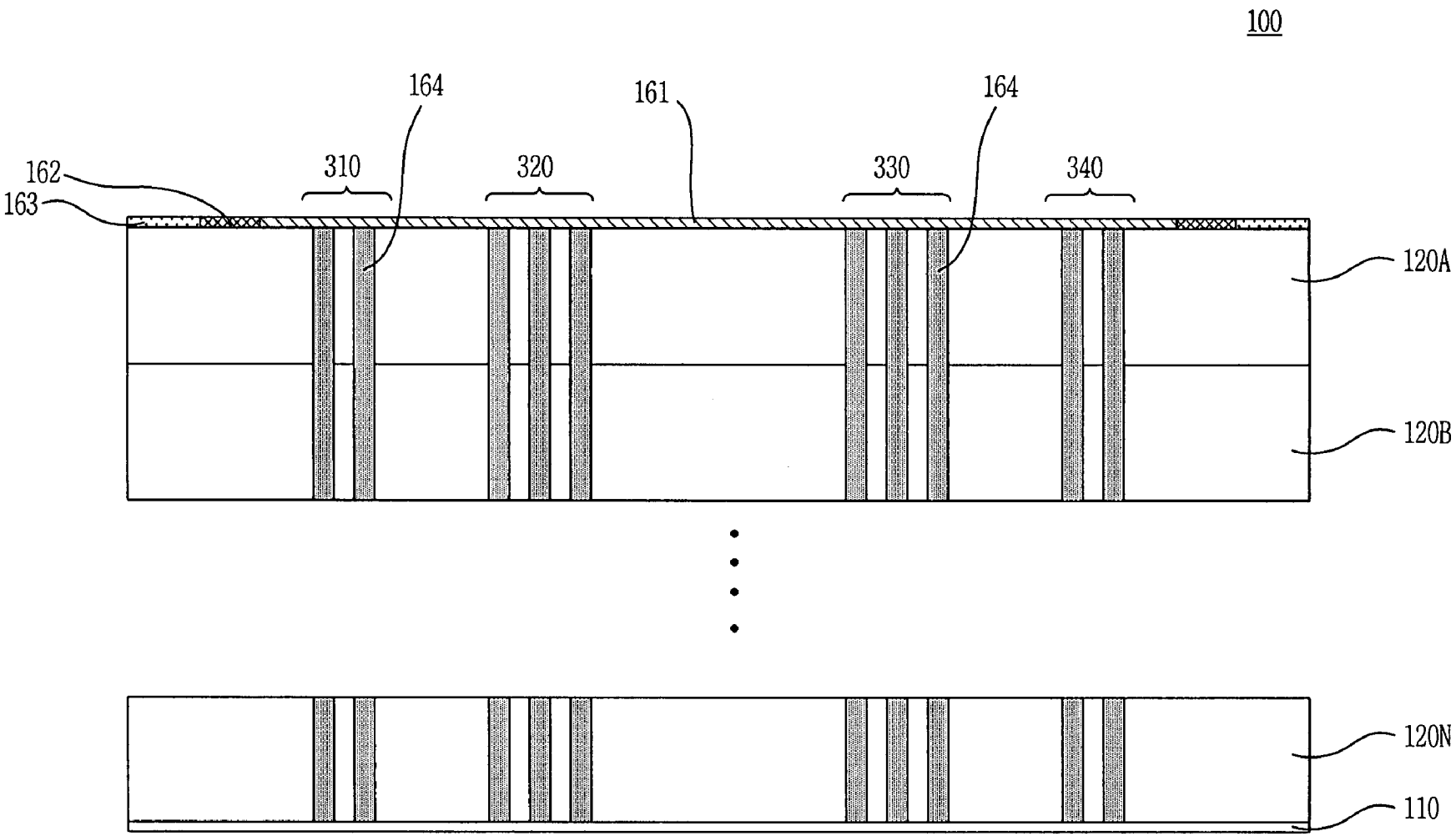
FIG. 3 is a cross sectional view taken along with II–II' of a waveguide filter in FIG. 1.

FIG. 3 is a cross sectional view taken along with: II–II' of a waveguide filter in FIG. 1.

As shown, the filtering unit 161 includes a plurality of via metals 164. The plurality of via metals 164 is formed by penetrating from the first dielectric layer 120A to the $N^{th}$ dielectric layer 120N. The plurality of via metals 164 is aligned in a predetermined pattern as a metal strip of a conventional E planar metal strip waveguide filter. The predetermined pattern of aligned plurality of via metals 164 is decided filter characteristics of the waveguide filter 100. The plurality of via metals 161 is filled with metallic material and is grouped into four separated groups 310 to 340. Each group includes two or three via metals 164 within the limited distance. Furthermore, each group separated from other groups with a predetermined distance which are wider than the limited distance.

Figure 4A:
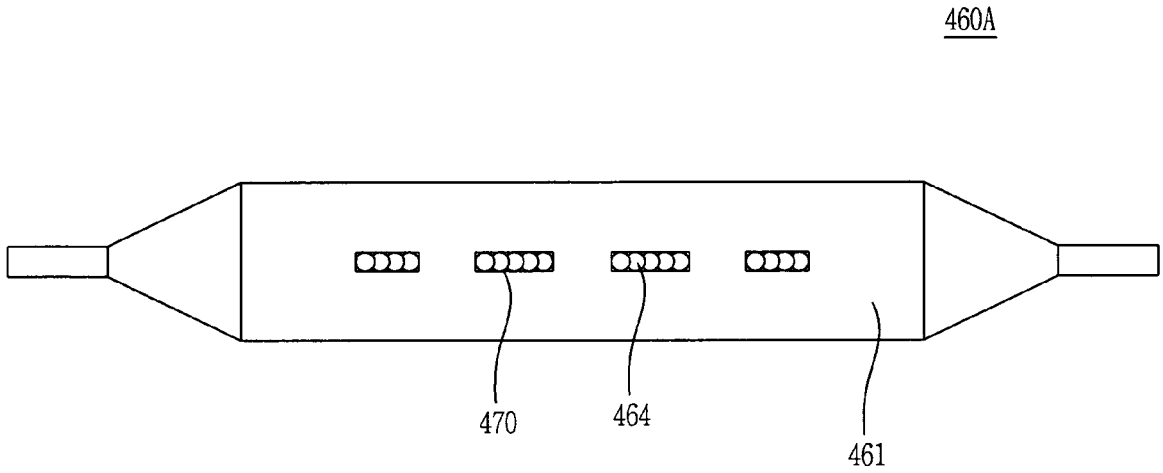
FIG. 4A is a top view of a waveguide in accordance with another preferred embodiment of the present invention.

FIG. 4A is a top view of a waveguide in accordance with another preferred embodiment of the present invention.

As shown, a plurality of via metals 464 of each group is arranged to be overlapped one another without the limited distance in a form of a cavity. After arranging a plurality of via metals 464, metallic material is filled inside of the overlapped via metals 470. Therefore, the overlapped via metals 470 become to a structure more similar to a metal strip of the conventional E planar metal strip waveguide filter.

Figure 4B:
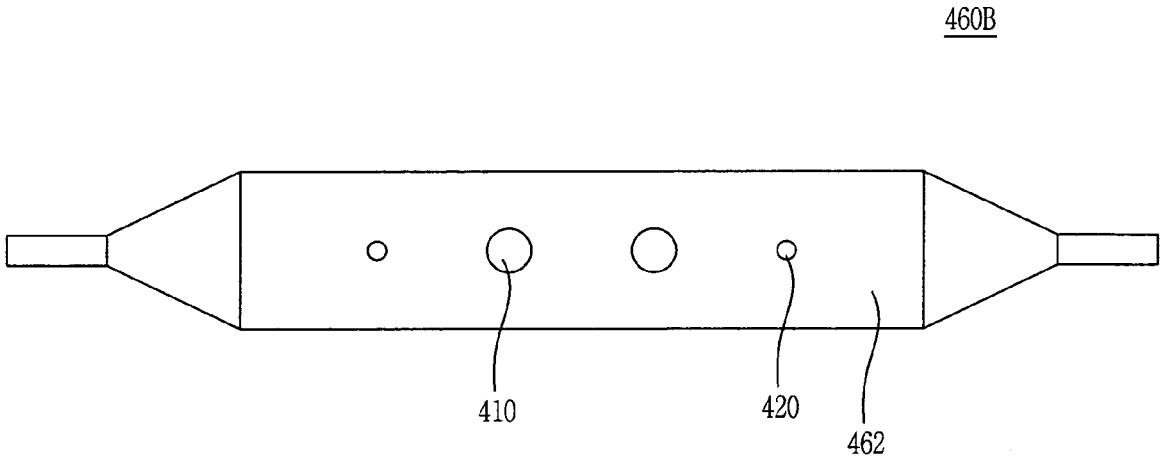
FIG. 4B is a top view of a waveguide in accordance with still another preferred embodiment of the present invention.

FIG. 4B is a top view of a waveguide in accordance with still anther preferred embodiment of the present invention.

As shown in FIG. 4B, different diameter of via metals 410 and 420 are used for embodying a circular post of the conventional E planar metal strip waveguide filter.

Figure 5:
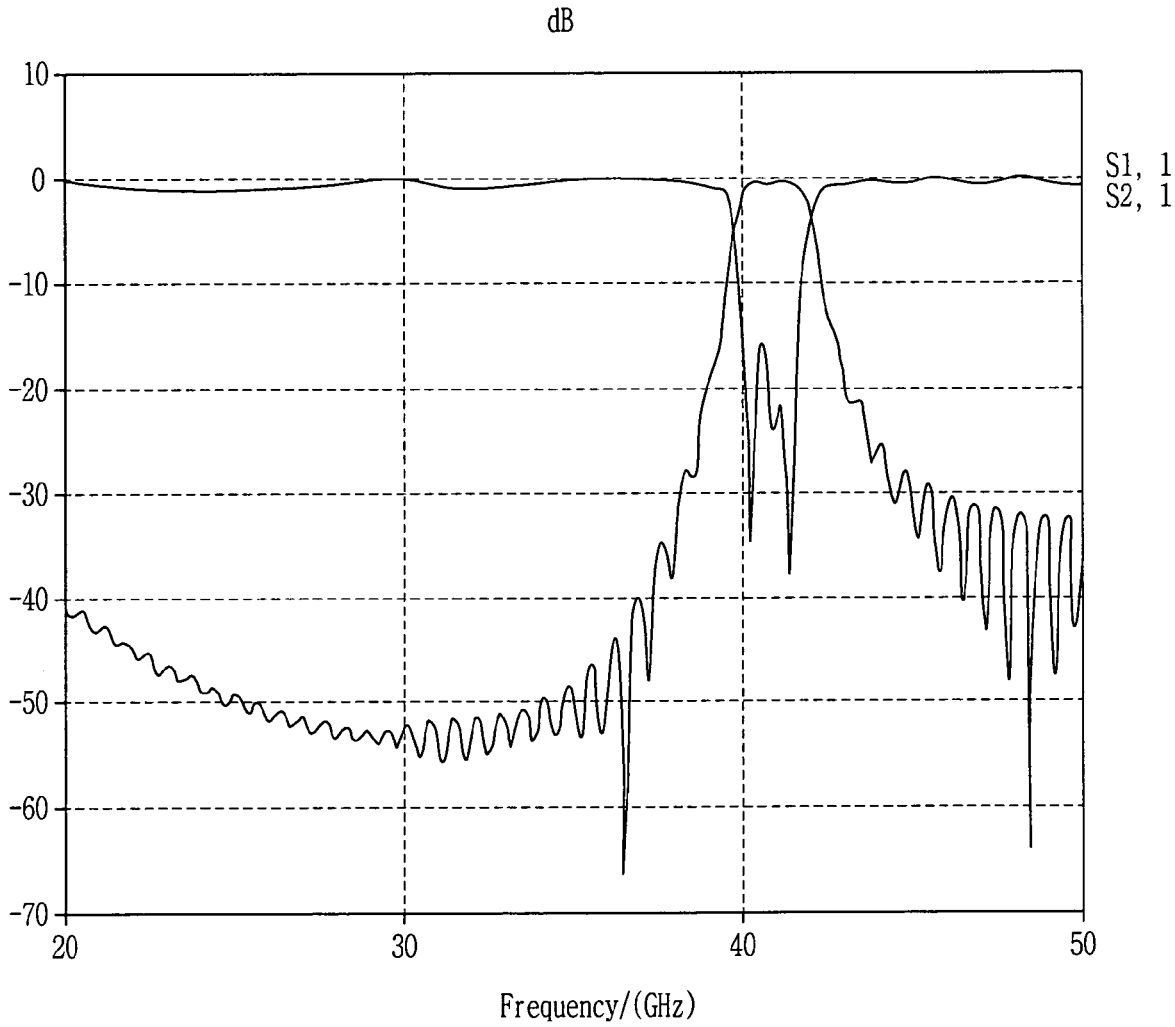
FIG. 5 is a graph showing a performance of a waveguide filter in accordance with a preferred embodiment of the present invention.

FIG. 5 is a graph showing a performance of a waveguide filter in accordance with a preferred embodiment of the present invention.

As shown, the waveguide filter 100 of the present invention has a bandwidth of a range between 40.5 to 41.5 GHz and a band as 1 GHz.

As mentioned above, the waveguide filter of the present invention can reduce an insertion loss by arranging two lines of a plurality of via metals in a form of zigzag fashion as side walls.

Also, the waveguide filter of the present invention can increase productivity by arranging one line of plurality of via metals within two different predetermined distance as a metal strip in a form of a line, a form of cavity and by using different diameters of via metals.

Furthermore, the waveguide filter of the present invention can increase flexibility of manufacturing since a height of the waveguide filter of the present invention is easily controlled to adjust with a height of other device connected to the waveguide filter of the present invention since a plurality of via metals is used as a metal strip.

The present invention contains subject matter related to Korean patent application No. KR 2003-0078477, filed in the Korean patent office on Nov. 6, 2003, the entire contents of which being incorporated herein by reference.

While the present invention has been described with respect to certain preferred embodiments, it will be apparent to those skilled in the art that various changes and modifications may be made without departing from the spirit and scope of the invention as defined in the following claims.

What is claimed is:

1. A waveguide filter comprising:

a lower conductive layer;

a plurality of dielectric layers stacked on the lower conductive layer;

an upper conductive layer formed on a top surface of the plurality of dielectric layers;

a waveguide formed on the upper conductive layer; and two sets of first via metals arranged at longitudinal sides of the waveguide filter, wherein each of the sets form a two-fold line shape, wherein the waveguide includes:

filtering units formed in middle of the waveguide and including groups of a plurality of second via metals;

a pair of transitions coupled to both sides of the filtering units; and a pair of input/output ports each of which coupled to each of the transitions, respectively, wherein the plurality of second via metals in each group are arranged in an overlapped manner in order to form a cavity and the overlapped second via metals are filled with a metallic material.

2. The waveguide filter of claim 1, wherein the plurality of second via metals are arranged as one line in the middle of the filtering unit.

3. The waveguide filter of claim 1, wherein the waveguide is formed between two sets of first via metals.

4. The waveguide filter of claim 2, wherein the plurality of second via metals are grouped within a predetermined number of via metals within a first predetermined distance and each group of second via metals is distanced within a second predetermined distance.

5. The waveguide filter of claim 1, wherein the two sets of first via metals are arranged to both ends of longitudinal sides of the waveguide filter in order to cover the pair of input/output ports.

6. The waveguide filter of claim 2, wherein each of the second via metals has a different diameter.

7. The waveguide filter of claim 1, the plurality of dielectric layers is a low temperature cofired ceramics plate.

8. The waveguide filter of claim 1, the transitions match impedances of the pair of input/output ports and an impedance of the waveguide.

9. The waveguide filter of claim 1, wherein the pair of input/output ports is one of a microstrip line, strip line, and a coplanar-waveguide.

* * * * *